US006230684B1

(12) United States Patent
Furuhashi et al.

(10) Patent No.: US 6,230,684 B1
(45) **Date of Patent: *May 15, 2001**

(54) FUEL SUPPLY APPARATUS FOR DIRECT INJECTION TYPE GASOLINE ENGINE

(75) Inventors: Tsutomu Furuhashi, Anjo; Tomomi Hioki, Kariya; Hiroshi Inoue, Chiryu, all of (JP)

(73) Assignee: Denso Corporation (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/841,581

(22) Filed: Apr. 30, 1997

(30) Foreign Application Priority Data

May 20, 1996 (JP) ..... 8-123850

(51) Int. Cl.[7] ..... F02M 37/04
(52) U.S. Cl. ..... 123/467; 123/456; 138/113
(58) Field of Search ..... 123/456, 447, 123/467, 446, 500, 501, 458; 138/113

(56) References Cited

U.S. PATENT DOCUMENTS

| | | | | |
|---|---|---|---|---|
| 4,056,679 | * | 11/1977 | Brandt | 138/113 |
| 4,295,452 | * | 10/1981 | Lembke | 123/470 |
| 4,615,320 | * | 10/1986 | Fehrenbach | 123/467 |
| 4,649,884 | * | 3/1987 | Tuckey | 123/468 |
| 4,660,524 | * | 4/1987 | Bertsch | 123/468 |
| 4,729,360 | * | 3/1988 | Fehrenbach et al. | 123/467 |
| 4,877,187 | * | 10/1989 | Daly | 123/447 |
| 5,355,859 | * | 10/1994 | Weber | 123/497 |
| 5,404,855 | * | 4/1995 | Yen | 123/456 |
| 5,456,233 | * | 10/1995 | Felhofer | 123/447 |
| 5,505,181 | * | 4/1996 | McRae | 123/456 |
| 5,507,266 | * | 4/1996 | Wright | 123/497 |
| 5,575,262 | * | 11/1996 | Rohde | 123/467 |
| 5,617,827 | * | 4/1997 | Eshleman | 123/467 |
| 5,785,025 | * | 7/1998 | Yoshiume | 123/497 |
| 5,848,583 | * | 12/1998 | Smith | 123/497 |

FOREIGN PATENT DOCUMENTS

| | | |
|---|---|---|
| 63-100262 | 5/1988 | (JP) . |
| 5-1854 U | 11/1993 | (JP) . |

* cited by examiner

*Primary Examiner*—Carl S. Miller
(74) *Attorney, Agent, or Firm*—Nixon & Vanderhye PC

(57) ABSTRACT

A common rail delivers fuel to a fuel injection valve for injecting fuel directly into each combustion chamber of a direct injection type gasoline engine. A connected accumulator incorporates a gas-sealed type damper. A body portion of the damper can stretch and shrink by being constructed of a metallic bellows, and gas is sealed in the metallic bellows. The pressure at which the gas is initially sealed within the damper is set for 4 Mpa or more, more preferably, for 8 Mpa or more. Further, to secure suppression of a variation in normal operation fuel pressure (for example, 10–12 Mpa), the pressure at which the gas is initially sealed within the damper is set to be lower than the normal operation fuel pressure, more preferably, lower than the normal operation fuel pressure by 1 Mpa or more.

24 Claims, 3 Drawing Sheets

FUEL SUPPLY APPARATUS FOR DIRECT INJECTION TYPE GASOLINE ENGINE

CROSS REFERENCE TO RELATED APPLICATIONS

This application is based on and claims priority of Japanese Patent Application No. Hei. 8-123850 filed on May 20, 1996, the contents of which are incorporated herein by reference.

BACKGROUND OF THE INVENTION

1. Field of the Invention

The present invention relates to fuel supply apparatus for a direct injection type gasoline engine, for injecting high-pressure fuel directly into each cylindrical combustion chamber of the engine.

2. Description of Related Art

Recently, to improve economical fuel consumption and engine output power, a direct injection type gasoline engine has been developed in which fuel is injected directly into each cylindrical combustion chamber. In such a direct injection type gasoline engine, to facilitate atomization of fuel (gasoline) to be injected directly into each combustion chamber, the pressure of fuel supplied to fuel injection valves (fuel pressure) is increased to be high. Preferably, the fuel pressure should be increased to a high level promptly. Further, when fuel pressure varies during operation of the engine, the amount of injected fuel varies, and emission or driveability deteriorates. Therefore, it is preferable that fuel pressure should be maintained at a substantially constant value by suppressing variation in fuel pressure during the engine operation.

To secure increase of fuel pressure at starting and to suppress sequential fuel pressure variation, as shown in JP-U-5-1854, an accumulator is connected to a common rail (delivery pipe) for the fuel injection valve of each cylinder. A control valve and a high-pressure regulator for regulating fuel pressure is connected to the common rail, so that variation in fuel pressure during engine operation is suppressed by the high-pressure regulator. Further, during engine operation, the control valve is opened to introduce a part of the high-pressure fuel into the accumulator. At stopping of the engine, the control valve is closed to seal up high-pressure fuel in the accumulator. Subsequently at starting of the engine, the control valve is opened to introduce high-pressure fuel already in the accumulator into the common rail so that the rail fuel pressure is increased promptly at engine starting to improve starting performance.

However, in the above-described fuel supply apparatus, since the control valve, accumulator, and high-pressure regulator are necessary to secure improved starting performance while also suppressing sequential fuel pressure variation, the construction of the fuel supply system is complicated and contrary to desired requirements of small-sized apparatus and low cost.

SUMMARY OF THE INVENTION

In view of the above-described problems, an object of the present invention is therefore to provide a fuel supply apparatus for a direct fuel injection type gasoline engine which has a simplified construction to reduce its cost and size.

According to the present invention, a fuel supply apparatus for a direct injection type gasoline engine includes a damper, in which gas is sealed, stretching and shrinking in a direction to suppress variation in fuel pressure in a common rail. A pressure at which gas is initially sealed within said damper is set to be greater than a predetermined pressure required for atomizing fuel.

To reduce variation in the common rail fuel pressure , it is advantageous to increase the volume of the common rail; however, when the common rail volume is increased, an increase in common rail fuel pressure at engine starting is delayed and starting performance deteriorates.

According to the present invention, when the common rail fuel pressure lowers at engine stops, the damper is displaced in a direction to suppress an increase in fuel pressure, i.e., in a direction as to reduce the volume in which fuel is sealed. Therefore, the state at engine starting is substantially the same as where the common rail volume is reduced, and the desired increase in fuel pressure at engine starting is accelerated. Further, since variation in fuel pressure can be suppressed by stretching and shrinking of the damper, the common rail volume can be reduced. In addition, since the pressure at which gas is initially sealed within the damper is set to be greater than a predetermined pressure required for atomizing fuel injected from the injection valve, at starting, the damper does not move until the fuel pressure reaches a predetermined value. Thus the volume in which the fuel is sealed is maintained at a minimum. In this way, it is possible to increase fuel pressure at starting promptly to be greater than a predetermined value required for atomizing fuel injected from the injection valve. Accordingly, favorable combustion can be secured early, and favorable starting performance can be secured. Further, during engine operation, the damper shrinks until the pressure of the gas sealed in the damper is balanced with the fuel pressure. In this state, the damper stretches according to variation in fuel pressure so that variation in fuel pressure can be suppressed.

Thus, according to the present invention, by using a gas-sealed type damper, both of the desired performances (increasing fuel pressure at starting and subsequent suppression of variation in fuel pressure) can be secured. Therefore, as compared with the situation where the control valve, accumulator and high-pressure regulator are assembled, construction is simplified, and cost and size can be reduced.

The pressure at which gas is initially sealed within the damper may preferably be set for 4 MPa or more, more preferably, for 8 MPa or more.

Further, the pressure at which the gas is initially sealed within the damper may be set to be lower than normal operation fuel pressure within the common rail, more preferably, lower than normal operation fuel pressure within the common rail by 1 MPa or more.

BRIEF DESCRIPTION OF THE DRAWINGS

Additional objects and advantages of the present invention will be more readily apparent from the following detailed description of preferred embodiments thereof when taken together with the accompanying drawings in which.

DESCRIPTION OF THE PREFERRED EMBODIMENT

Figure 1:
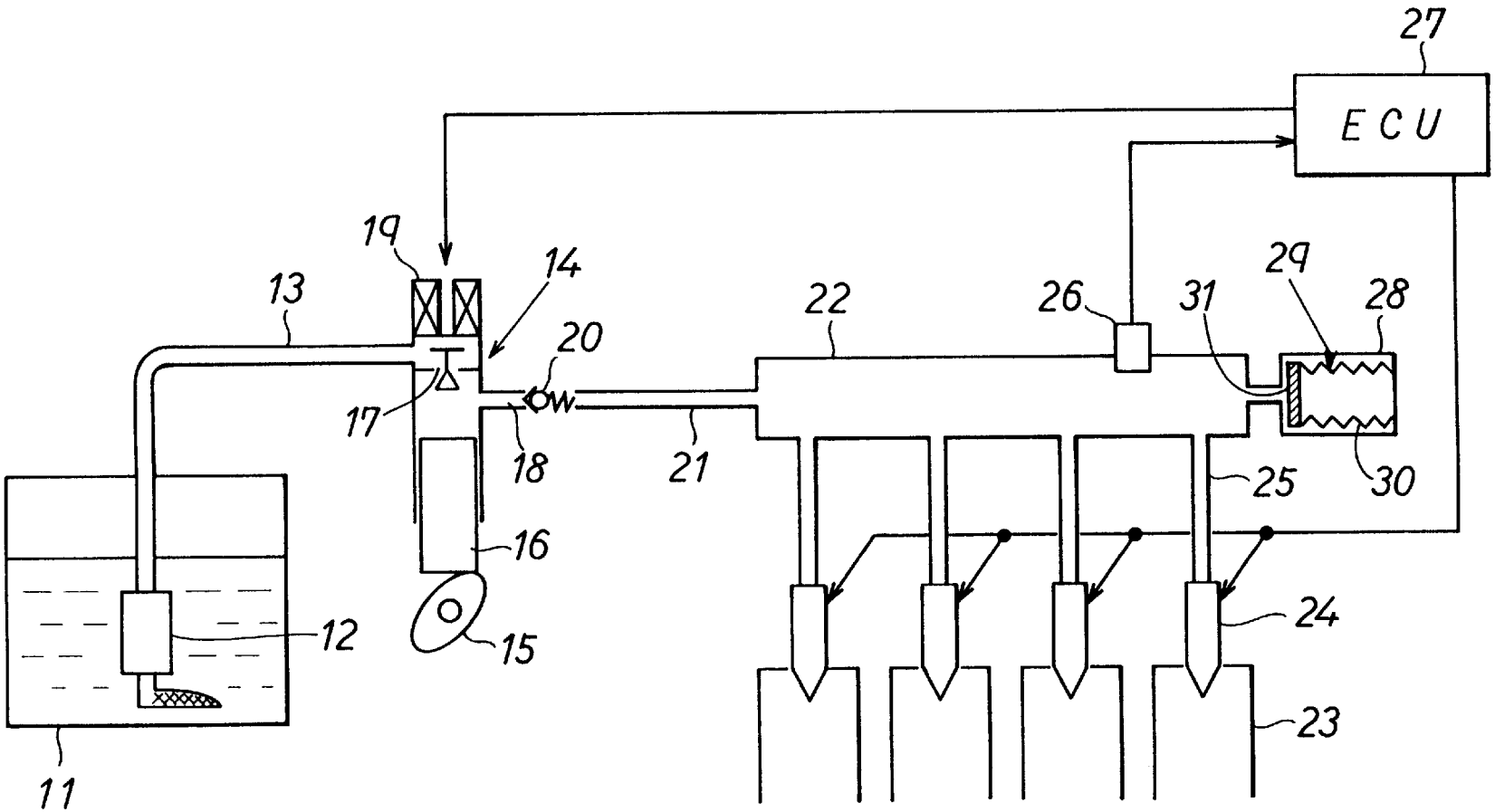
FIG. 1 is a schematic view showing an entire construction of a fuel supply apparatus for a direct injection type gasoline engine according to an embodiment.

An embodiment of the present invention will be described with reference to the accompanying drawings. A construction of an entire fuel supply apparatus for a direct injection type gasoline engine will be described with reference to FIG. 1. Within fuel tank 11, there is disposed a feed pump 12 for pressurizing and pumping fuel (gasoline). The feed pump 12 is operated by electric power supplied from a battery (not shown) mounted on a vehicle. A high-pressure fuel pump 14 is connected to a discharge port side of the feed pump 12 through fuel pipe 13. The high-pressure fuel pump 14 accommodates therein a plunger 16 driven by a cam shaft 15 of the engine and pumps out high-pressure fuel from a discharge port 18 by a reciprocating movement of the plunger 16. Further, at a suction side of the high-pressure fuel pump 14, there is disposed an electromagnetic valve 19 for opening or closing the suction port 17.

To the discharge port 18 of the high-pressure pump 14 is connected a common rail 22 through a check valve 20 and the fuel pipe 21. The high-pressure fuel accumulated in the common rail 22 is supplied to a fuel injection valve mounted on each cylinder 23 through a branch supply pipe 25. To the common rail 22 is attached a fuel pressure sensor 26 for detecting fuel pressure, and an output signal of the fuel pressure sensor 26 is input to an electric control unit 27 (hereinafter referred to as "ECU").

The ECU 27 controls an injection operation of the fuel injection valve 24 and also performs feed back control on the electromagnetic valve 19 according to a deviation between an actual fuel pressure detected by the fuel pressure sensor 26 and a target fuel pressure. In this way, the fuel pressure approaches the target fuel pressure by adjusting a discharge amount of fuel at a proper value.

Figure 2:
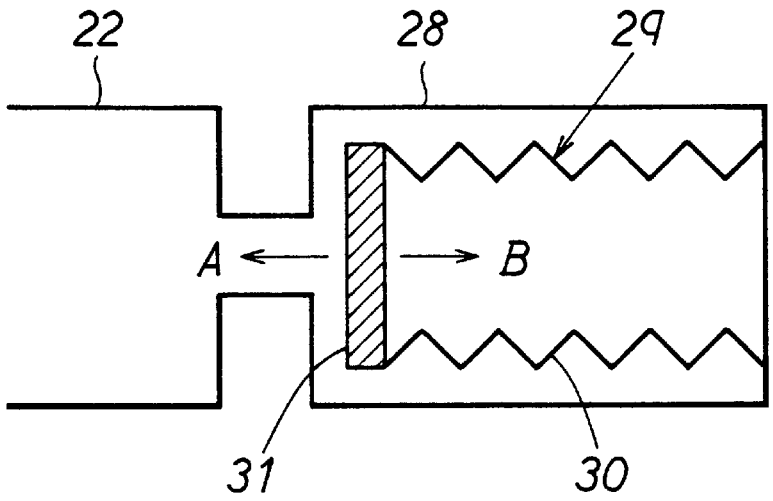
FIG. 2 is a vertical cross sectional view showing an accumulator according to the embodiment.

An accumulator 28 is connected to the common rail 22 in such a manner that a part of the high-pressure fuel introduced into the common rail 20 flows into the accumulator 28. Within the accumulator 28, there is provided a gas-sealed type damper 29. As shown in FIG. 2, a body portion of the damper 29 is constructed by a metallic bellows. One end opening of the metallic bellows is closed by an end plate 31 and a peripheral portion of the other end is joined to an end surface of the accumulator 28 by an adhesive or the like to form a closed space within the bellows 30. The gas such as nitrogen and argon is sealed in the closed space.

In this case, a pressure at which the gas is initially sealed within the damper 29 (hereinafter simply referred to as "gas initial sealing pressure of the damper 29") is set to be greater than a predetermined fuel pressure required for atomizing fuel injection of the fuel injection valve 24; preferably, more than 4 MPa; and more preferably, more than 8 MPa. Further, to secure an effect for suppressing a variation in the normal operation fuel pressure (e.g., 10–12 MPa), the gas initial sealing pressure of the damper 29 is set to be lower than a predetermined normal operation fuel pressure; more preferably, lower than the predetermined normal operation fuel pressure by 1 MPa or more. Here, the gas initial sealing pressure of the damper 29 means a pressure when the gas is sealed in the damper 29 and is equal to a pressure where the damper 29 stretches at the maximum (i.e., where the end plate 31 of the damper 29 contacts an end surface at the inlet side, of the accumulator).

When the fuel pressure within the common rail 22 is lower than the gas initial sealing pressure of the damper 29, the end plate 31 of the damper 29 contacts an end surface at the inlet side, of the accumulator and does not move. Therefore, the end surface of the inlet side, of the accumulator is a limited position (initial position) of the metallic bellows 30 of the damper 29 in the stretching direction. When the fuel pressure in the common rail 22 gradually rises and exceeds the gas initial sealing pressure of the damper 29, the metallic bellows 30 of the damper 29 shrinks in a direction of an arrow B in FIG. 2, and in this state, the metallic bellows 30 stretches or shrinks according to a variation in the fuel pressure to suppress the variation in the fuel pressure. Conventionally, a volume of the common rail is set large enough to reduce the variation in the fuel pressure to a predetermined value; however, according to this embodiment, as described above, since the variation in the fuel pressure can be suppressed by the damper 29, a volume of the common rail 22 can be reduced.

Figure 3A:
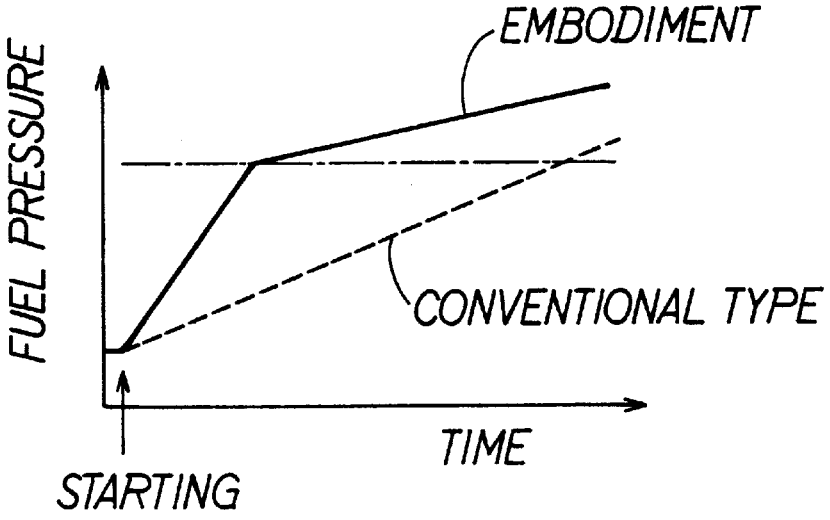
FIG. 3A is a graph showing characteristics of fuel pressure.

The characteristics of fuel pressure at starting of the engine when the gas initial sealing pressure of the damper 29 is set for an allowable lower limit value (4 MPa) of the fuel pressure is shown by a solid line in FIG. 3A. In this case, an increasing rate of the fuel pressure at starting varies before and after the allowable lower limit value of the fuel pressure. That is, before the fuel pressure exceeds the allowable lower limit value at starting, the end plate 31 of the damper 31 contacts the end surface at the inlet side, of the accumulator 28 and does not move, and after the fuel pressure exceeds the allowable lower limit value, the metallic bellows 30 of the damper 29 shrinks according to the increase of the fuel pressure, the volume within the accumulator 28, into which the fuel is sealed, is increased. In this way, the fuel pressure increases slowly.

While the engine stops, the high-pressure fuel is sealed in the common rail 22 by closing the check valve 20; however, the fuel pressure lowers due to a decrease of the temperature of the fuel in the common rail 22, a leakage of the check valve 20 or the like. Thus, when the fuel pressure within the common rail 22 lowers while the engine stops, the metallic bellows 30 of the damper 29 stretches in a direction of an arrow A in FIG. 2 until the pressure of the gas sealed within the damper 39 is balanced with the fuel pressure at the side of the common rail 22, and pushes out fuel in the accumulator 28 into the common rail 22 to reduce the decrease of the fuel pressure in the common rail 22.

Therefore, the volume of the common rail 22 can be reduced by the damper 29, and as shown by the solid line in FIG. 3A, the fuel pressure in the common rail 22 can be increased promptly at starting of the engine to improve the starting performance of the engine. In a case without the damper 29, the volume of the common rail 22 should be made large enough to suppress the variation in the fuel pressure. As compared with the case where the damper 29 is employed, the volume into which the fuel is sealed at starting is increased, and as much, a large amount of the discharge fuel is necessary to increase the fuel pressure at starting. As shown by a chain line in FIG. 3A, the increase in the fuel pressure is delayed, and the starting performance deteriorates.

Figure 3B:
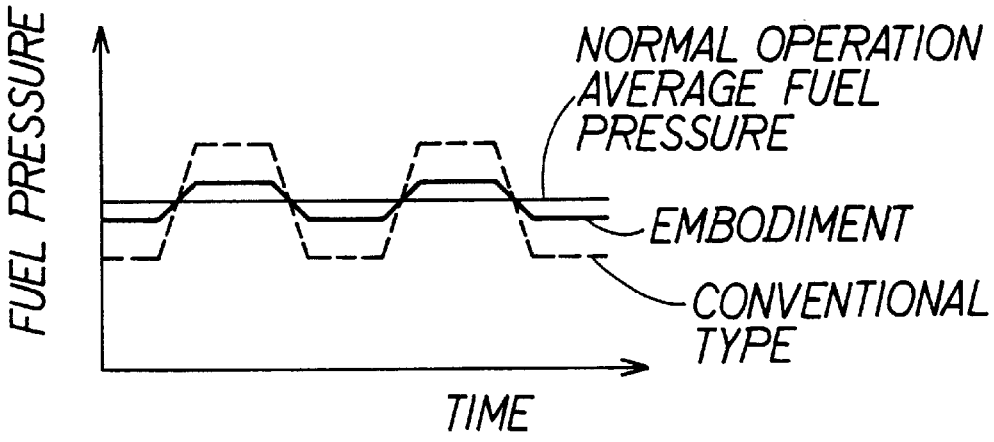
FIG. 3B is a graph showing a variation in fuel pressure during an operation of an engine.

Further, during the operation of the engine, as shown in FIG. 3B, the fuel pressure varies every time fuel is injected from the fuel injection valves 24; however, according to this embodiment, when the fuel pressure in the common rail 22 varies to be lowered, the metallic bellows 30 of the damper 29 stretches in the direction of the arrow A (left direction) in FIG. 2 to push out fuel in the accumulator 28 into the common rail 22 to reduce the decrease in the fuel pressure. On the other hand, when the fuel pressure in the common rail 22 varies to be increased, the metallic bellows 30 of the damper 29 shrinks in the direction of the arrow B (right direction) in FIG. 2 and introduces a part of fuel in the common rail 22 into the accumulator 28 to reduce the increase in the fuel pressure in the common rail 22.

Thus, the damper 29 stretches and shrinks according to the variation in the fuel pressure so that the variation in the fuel pressure can be reduced as shown by the solid line in FIG. 3B to improve the driveability. In a case without the damper 29, as shown by the chain line in FIG. 3B, the variation in the fuel pressure increases to give an adverse influence on the emission and driveability.

Figure 4:
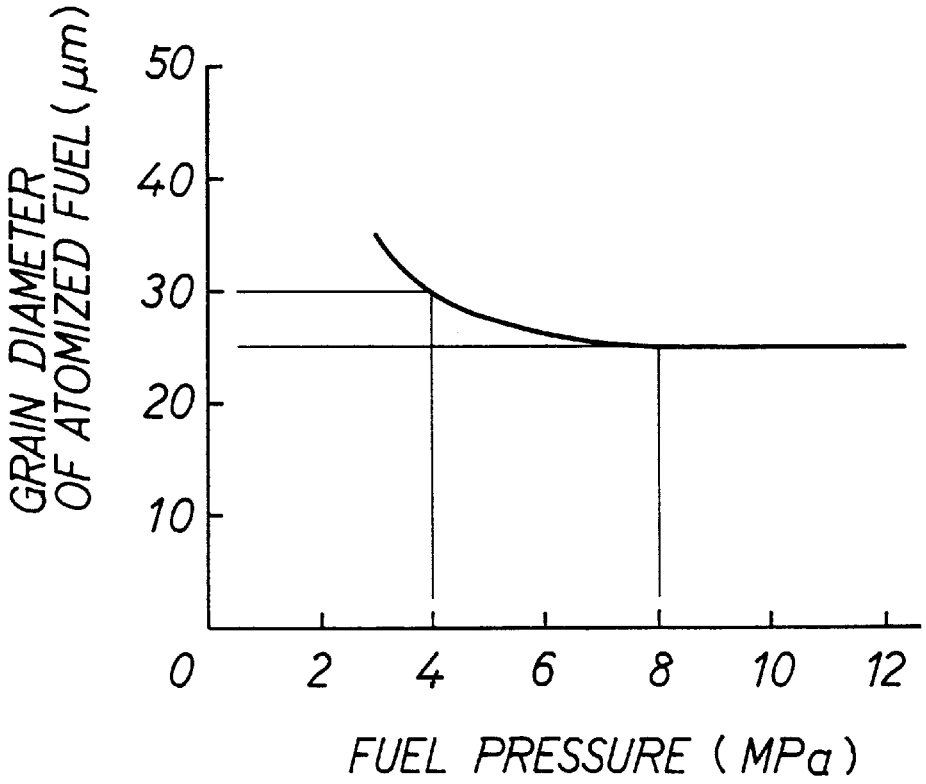
FIG. 4 is a graph showing a relationship between fuel pressure and a grain diameter of atomized fuel.

Next, a study of the relationship between the gas initial sealing pressure and characteristics of an injection or the performance for suppressing the variation in the fuel 30 pressure will be described. In the direct injection gasoline engine, to facilitate a mixture of the fuel injected directly into the combustion chamber and the air in the combustion chamber, it is necessary to atomize a grain diameter of the fuel. As shown in FIG. 4, the grain diameter of the atomized fuel depends on the fuel pressure, and therefore, an allowable value of the fuel pressure is determined by an allowable value of the grain diameter of the atomized fuel.

Generally, to secure a favorable combustion performance by facilitating a mixture of the atomized fuel and the air in the combustion chamber, it is necessary that the grain diameter of the atomized fuel is equal to 30 $\mu$m or less. Therefore, it is necessary that the fuel pressure is maintained at 4 MPa or more, as obtained from the characteristics in FIG. 4. Accordingly, the allowable fuel pressure lower limit value becomes 4 MPa. Further, to secure more preferable combustion performance, it is necessary that the grain diameter of the atomized fuel is equal to 25 $\mu$m or less. Therefore, it is necessary that the fuel pressure is maintained at 8 MPa or more, as obtained from the characteristics in FIG. 4.

While considering the above-described circumstances, preferably, the gas initial sealing pressure of the damper 29 is set for at least the allowable fuel pressure lower limit (4 MPa) or more. In this case, the damper 29 does not shrink and the volume of the fuel sealed in the accumulator 28 is maintained at the minimum until the fuel pressure at starting becomes the allowable fuel pressure lower limit or more. Therefore, it is possible to promptly increase the fuel pressure to be equal to the allowable fuel pressure lower limit or more. Accordingly, the favorable combustion can be secured promptly, and the favorable starting performance can be secured promptly.

Further, when the gas initial sealing pressure of the damper 29 is set for 8 MPa or more, the damper 29 does not shrink until the fuel pressure at starting becomes 8 MPa. Therefore, the fuel pressure can be increased to be equal to 8 MPa or more promptly, and more preferable starting performance can be secured.

However, when the gas initial sealing pressure becomes the normal operation fuel pressure (for example, 10–12 MPa), the damper 29 does not move against the variation in the fuel pressure which is equal to the gas initial sealing pressure or less, and the suppression of the variation in the fuel pressure is incomplete. Accordingly, the gas initial sealing pressure of the damper 29 is preferably set to be lower than at least the normal operation fuel pressure.

Further, during a normal operation of the engine, the variation in the fuel pressure occurs within a range of approximately±1 MPa. When the gas initial sealing pressure of the damper 29 is set within a range of the normal variation of the normal operation fuel pressure, even in the normal variation in the fuel pressure, the damper 29 does not move in a region where the variation in the fuel pressure is equal to the gas initial sealing pressure or less, and the suppression of the variation in the fuel pressure is incomplete. Accordingly, when the gas initial sealing pressure of the damper 29 is set to be lower than at least the normal operation fuel pressure by 1 MPa, that is, is set for a pressure lower than a range of the normal variation of the normal operation fuel pressure, the damper 29 can be certainly operated within a range of the normal variation of the normal operation fuel pressure, and the stabilized performance for suppressing the variation in the fuel pressure can be secured.

In the above-described embodiment, the damper 29 is disposed within the accumulator 28 connected to the common rail 22; however, the damper may be disposed within the common rail 22 to omit the accumulator 28. Further, in the above-described embodiment, the feed pump 12 for pumping fuel from the fuel tank 11 is disposed within the fuel tank 11; however, the feed pump may be disposed outside the fuel tank 11, and a suction pipe of the feed pump may be introduced into the inside of the fuel tank 11.

Although the present invention has been fully described in connection with the preferred embodiments thereof with reference to the accompanying drawings, it is to be noted that various changes and modifications will become apparent to those skilled in the art. Such changes and modifications are to be understood as being included within the scope of the present invention as defined in the appended claims.

What is claimed is:

1. A fuel supply apparatus for improving engine starting performance in a direct injection type gasoline engine having a combustion chamber, said apparatus comprising:

a fuel pump driven by said engine for pressurizing and pumping fuel;

a common rail for accumulating fuel sent from said engine-driven fuel pump;

a fuel injection valve for injecting fuel delivered from said common rail directly into said combustion chamber; and a damper, in which gas is sealed, in communication with fuel in said rail, said damper stretching and shrinking in a direction to suppress variation in fuel pressure in said common rail, said gas being initially sealed within said damper at a pressure of 4 MPa or more, said pressure at which said gas is initially sealed within said damper being greater than that required for atomizing fuel in a direct injection type fuel supply system, and said pressure at which said gas is initially sealed within said damper precluding movement of said damper at engine start-up until fuel pressure in said common rail is increased to a predetermined pressure required for atomizing fuel, and allowing said damper to move to suppress variation in fuel pressure in said common rail after fuel pressure in the common rail exceeds said predetermined pressure required for atomizing fuel, and wherein fuel pressure in the common rail is decreased when the engine stops.

2. A fuel supply apparatus as in claim 1 wherein said pressure at which said gas is initially sealed within said damper is 8 Mpa or more.

3. A fuel supply apparatus as in claim 1 wherein said pressure at which said gas is initially sealed within said damper is lower than fuel pressure within said common rail during normal engine operation.

4. A fuel supply apparatus as in claim 1 wherein said pressure at which said gas is initially sealed within said damper is lower than fuel pressure within said common rail during normal engine operation by 1 Mpa or more.

5. A fuel supply apparatus as in claim 1 wherein said pressure at which said gas is initially sealed within said damper is lower than 9 Mpa.

6. A fuel supply apparatus as in claim 1 wherein said damper includes a metallic bellows which stretches and shrinks responsive to variation in fuel pressure in said common rail.

7. A fuel supply apparatus as in claim 1 further comprising:

an accumulator connected to said common rail in fluid communication therewith, wherein said damper is disposed within said accumulator.

8. A fuel supply apparatus as in claim 1 further comprising:

a feed pump for supplying low-pressure fuel to said engine-driven fuel pump.

9. A direct fuel injection system for directly injecting fuel into a combustion chamber of an engine at a high pressure that is sufficiently high to atomize injected fuel as it is being injected directly into a combustion chamber, said system comprising:

an engine driven high pressure fuel pump connected to supply high pressure fuel to a common fuel supply rail for feeding high pressure fuel through injection valves directly into combustion chambers of an engine, wherein fuel pressure in said common rail is decreased when the engine stops, and an expandable and compressible sealed damper with at least one movable surface in communication with fuel in said rail, said damper being sufficiently filled with material that expands to minimize fuel pressure variations above a lower limit that is at least sufficiently high to atomize fuel during direct injection to an engine combustion chamber, said damper being sufficiently filled with said expandable material so as to be precluded from movement during engine start-up until fuel pressure reaches a predetermined lower limit value, even when fuel pressure in the common rail is directly increased by the fuel pump.

10. A direct fuel injection system as in claim 9 wherein said sealed damper is filled with said material to cause said lower limit to be below a predetermined normal operational fuel pressure.

11. A direct fuel injection system as in claim 9 wherein said material comprises a gas.

12. A direct fuel injection system as in claim 9 wherein said lower limit is at least 4 Mpa.

13. A direct fuel injection system as in claim 12 wherein said lower limit is at least 8 Mpa.

14. A direct fuel injection system as in claim 9 wherein said lower limit is below 10 Mpa.

15. A direct fuel injection system as in claim 14 wherein said lower limit is below 9 Mpa.

16. A direct fuel injection system as in claim 9 further comprising:

an accumulator in fluid communication with said fuel rail; and wherein said damper is disposed within said accumulator.

17. A direct fuel injection system as in claim 9 further comprising:

an electrically driven fuel feed pump connected to supply lower pressure file to said engine-driven high pressure fuel pump.

18. A fuel supply apparatus as in claim 1, further comprising:

a control unit for adjusting an amount of fuel discharged from said fuel pump so that the fuel pressure in said common rail is set to a target pressure.

19. A fuel supply apparatus as in claim 1, wherein said fuel pump directly discharges high-pressure fuel into said common rail.

20. A direct fuel injection system as in claim 9, further comprising:

a control unit for adjusting an amount of fuel discharged from said fuel pump so that the fuel pressure in said rail is set to a target pressure.

21. A direct fuel injection system as in claim 9, wherein said fuel pump directly discharges high-pressure fuel into said rail.

22. A fuel supply apparatus for a direct injection type gasoline engine having a combustion chamber, said apparatus comprising:

a fuel pump, driven by said engine, for pressurizing and pumping fuel;

a common rail for accumulating fuel sent from said fuel pump;

a fuel injection valve for injecting fuel from said common rail directly into said combustion chamber;

a damper, in communication with fuel in said common rail, said damper suppressing variation in fuel pressure in said common rail, wherein a pressure of gas initially sealed within said damper is 4 MPa or more; and a control unit for adjusting an amount of fuel discharged from said fuel pump so that the fuel pressure in said common rail is set to a target pressure, wherein said pressure at which said gas is initially sealed within said damper precludes movement of the damper at engine start-up until fuel pressure in the common rail is increased to a predetermined pressure required for atomizing fuel, and allows movement of the damper to suppress variation in fuel pressure in said common rail after fuel pressure in the common rail becomes more than the predetermined pressure required for atomizing fuel, wherein fuel pressure in the common rail is decreased when the engine stops.

23. A fuel supply apparatus as in claim 22, wherein the fuel pressure in said common rail is in a range from 10 to 12 Mpa.

24. A fuel supply apparatus as in claim 22, wherein said fuel pump directly discharges high-pressure fuel into said common rail .

* * * * *